United States Patent [19]

Taylor

[11] Patent Number: 5,010,764

[45] Date of Patent: Apr. 30, 1991

[54] METHOD AND APPARATUS FOR LOGGING SHORT RADIUS HORIZONTAL DRAINHOLES

[75] Inventor: David E. Taylor, Lafayette, La.

[73] Assignee: Marathon Oil Company, Findlay, Ohio

[21] Appl. No.: 432,103

[22] Filed: Nov. 1, 1989

[51] Int. Cl.[5] ..... E21B 47/00

[52] U.S. Cl. ..... 73/151; 166/250

[58] Field of Search ..... 73/151, 152, 154, 155; 374/136, 143; 166/250, 384, 50, 100, 242; 175/45, 50, 75

[56] References Cited

U.S. PATENT DOCUMENTS

| | | | |
|---|---|---|---|
| 4,168,747 | 9/1979 | Youmans | 166/384 |
| 4,196,619 | 4/1980 | Collins | 73/155 |
| 4,267,727 | 5/1981 | Hoppe | 73/151 |
| 4,282,523 | 8/1981 | Youmans | 340/860 |
| 4,441,362 | 4/1984 | Carlson | 73/155 |
| 4,495,803 | 1/1985 | Beasley et al. | 73/151 |
| 4,560,934 | 12/1985 | Dickinson | 324/323 |
| 4,641,520 | 2/1987 | Nai-Hsein Mao | 73/151 |
| 4,805,448 | 2/1989 | Armell | 73/151 |

*Primary Examiner*—Jerry W. Myracle

*Attorney, Agent, or Firm*—Jack L. Hummel; Jack E. Ebel

[57] ABSTRACT

A method and apparatus for logging short radius horizontal drainholes. An end sub in a tubing string contains a bend which angles the downstream end of the sub with respect to the upstream end. A perforated sub is connected to the upstream end of the end sub and contains sensor means communicating with the exterior through the perforations. When the angled end sub is aligned with the horizontal drainhole, downward movement of the tubing string causes the string to move through the drainhole, thereby allowing the sensor to determine the conditions therein.

9 Claims, 2 Drawing Sheets

METHOD AND APPARATUS FOR LOGGING SHORT RADIUS HORIZONTAL DRAINHOLES

FIELD OF THE INVENTION

This invention relates to the logging of horizontal drainholes. More particularly, it relates to a method and apparatus for use in logging short radius horizontal drainholes.

BACKGROUND OF THE INVENTION

In order to maximize production from oil wells whose production has fallen below acceptable levels horizontal well bores or drainholes are sometimes drilled. The drilling operation typically is carried out by milling a section out of the casing in the area to be drilled and deflecting the drill at a predetermined angle into the wall of the vertical bore by means of a whipstock positioned just below the juncture of the existing vertical bore and the horizontal bore to be drilled. The drill will enter the surrounding formation at a relatively shallow angle to the vertical bore and is moved along an arcuate path which may terminate at approximately the elevation corresponding to the point of entry of the drill.

It is sometimes necessary to log the horizontal bore prior to production operations to determine information about the intersected formations. It can also be important to obtain pressure and temperature data from the horizontal drainhole after operations have begun in order to determine the cause of lower than anticipated recoveries. For example, if it is suspected that cross flow of oil and gas is occurring between individual fracture compartments intersected by the horizontal drainhole, pressure and temperature readings can be used to determine whether the cross flow is in fact occurring and where. With this information compartments of maximum oil flow can be isolated with lateral hole production packers and the isolated compartments can then be produced.

Conventional wireline techniques are inapplicable in logging horizontal drainholes because it is extremely difficult or impossible to guide a sensor supported only by a flexible wireline into and along the arcuate path of the drainhole. If the radius of the arcuate path of the horizontal drainhole is relatively long, for example, greater than about 10 meters, it is likely that conventional tubing-conveyed techniques can be used to move the sensor through the drainhole. Thus a tube string carrying a sensor at its end is normally capable of entering such a drainhole and traversing its gentle arc without becoming snagged or stuck. When the radius of the drainhole is short, for example less than about 10 meters, the problem of moving the sensor into and through the drainhole becomes much more difficult.

A variety of ways to move a sensor through a non-vertical bore hole have been suggested. Self-propelled sensor carriages developed for use in non-vertical holes are not suited to travel over the sharply curved path of the type of horizontal drainhole under discussion and, moreover, they are too expensive for the relatively short logging operation contemplated. Another suggestion is to provide a flexible sensing means which can be caused to move through a horizontal bore by pressurized fluid. This design, however, also is unnecessarily complicated for the contemplated use and it too is expensive due to the special fabric construction required.

Although is may be possible to design other specialized equipment to carry out this specialized function, the attendant high costs and the delays caused by the need to design and construct new equipment for each new situation would make such new designs undesirable. Ideally, the equipment for logging a short radius horizontal drainhole should make use of existing components, be simple in design, and be easy and inexpensive to fabricate. Prior to this invention such equipment was not known.

SUMMARY OF THE INVENTION

In carrying out the invention the lower portion of a tubing string is provided with sensor support means and with openings communicating with the interior of the tubing string in the vicinity of the sensor support means to thereby expose the interior to the environment, such as the pressure and temperature conditions, of the horizontal drainhole. In addition, the lower portion of the tubing string includes and end portion which extends transversely of the tubing string to facilitate entry of the tubing string into the horizontal drainhole and passage of the tubing string through the drainhole. Preferably, the end portion comprises an end tubing sub the end portion of which extends at an angle to the tubing string, and the portion of the tubing containing openings comprises a perforated tubing sub attached to the upstream end of the end tubing sub.

This arrangement makes use of readily available components the assembly of which is relatively simple and fast. Moreover, the method of using the equipment is equally simple, primarily requiring the angle of the end tubing sub to be aligned with the horizontal drainhole prior to moving it beyond the intersection of the vertical bore and the horizontal drainhole.

Other features and aspects of the invention, as well as other benefits thereof, may be ascertained from the more detailed description of the preferred embodiment which follows.

DESCRIPTION OF THE PREFERRED EMBODIMENT

Figure 1:
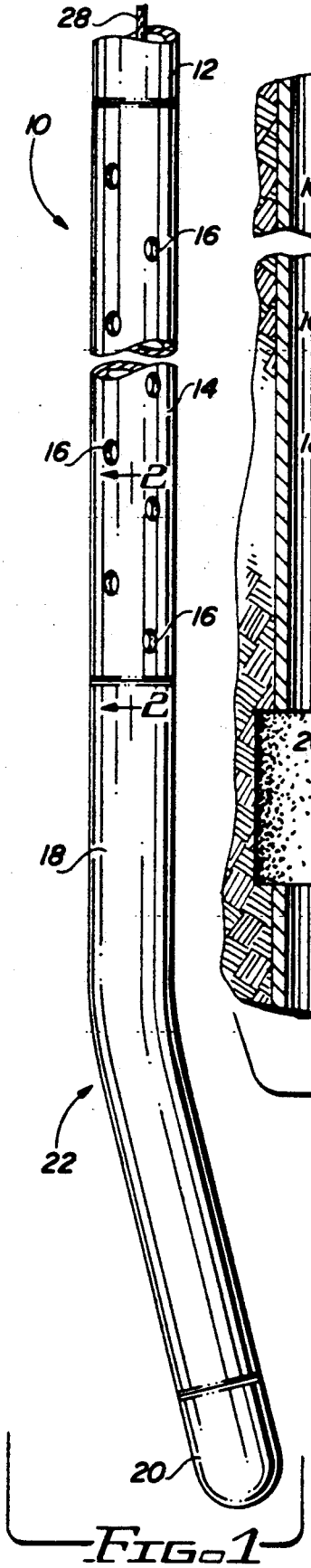
FIG. 1 is a side elevation of a portion of the tubing string utilized in the present invention.

Referring to FIG. 1, a tubing string 10 comprises a main tubing string section 12 vertically disposed as it would be when inserted into a vertical bore hole. Only the bottom portion of the tubing string section 12 is illustrated, it being understood that the section 12 will vary in length depending on the depth and length of the horizontal drainhole to be logged.

Attached to the downstream end of the tubing section 12 is a tubing sub 14 containing perforations 16. The sub 14 may be attached by conventional means, such as by threaded joints, not shown. The downstream end of the sub 14 is in turn connected in the same manner to the upstream end of tubing sub 18. The downstream end of the sub 18 carries a bullplug 20 of conventional design. Instead of being aligned throughout its length with the perforated sub 14 and the tubing section 12, the end sub 18 is bent as at 22 so that the downstream end portion of the sub 18 is disposed at an angle to its upstream portion.

Figure 2:
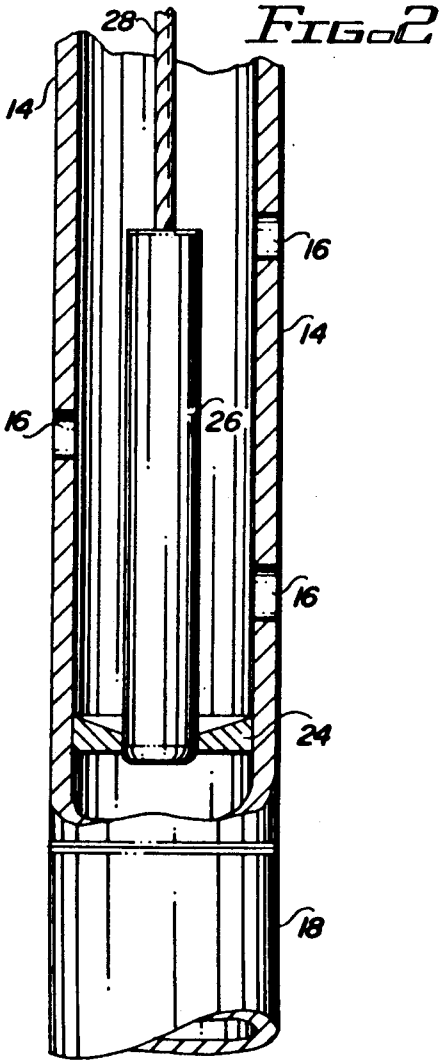
FIG. 2 is an enlarged partial longitudinal sectional view of the end portion of the tubing string with a sensor in place.

As shown in FIG. 2, the tubing sub 14 includes a sensor support seat 24, which may be of conventional design, located near the lowermost end of the sub. The support 24 is adapted to receive and hold in place a sensor 26, which may be of any desired style or design as long as it is adapted to be seated in the support seat 24 and is capable of detecting the drainhole conditions of interest. A conventional style of pressure/temperature bomb, for example, is contemplated for use in a horizontal drainhole in order to determine variations in pressure and temperature throughout the length of the drainhole. The sensor 26 is shown at the end of wireline 28 in a conventional arrangement wherein the sensor is supported by the wireline while being lowered into place and wherein the electrical lines which transmit signals from the sensor to the surface are interwoven in or supported by the wireline.

Figure 3:
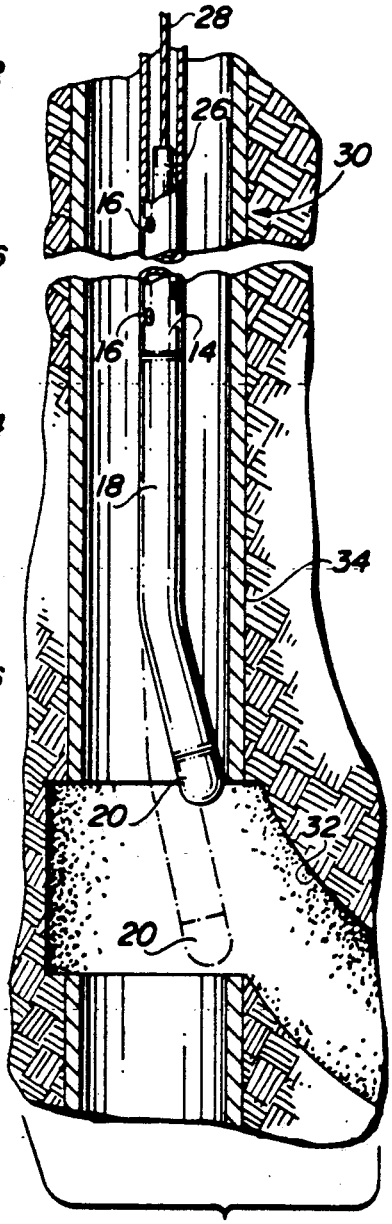
FIG. 3 is a partial longitudinal sectional view of a vertical bore hole and the initial portion of an intersecting horizontal drainhole, showing the tubing string of the present invention prior to entering the horizontal drainhole.

Referring to FIG. 3, a portion of a vertical bore hole 30 is shown with the end sub 18 poised at the intersection with horizontal drainhole 32. As in conventional, the bore hole 30 has been cased, as at 34, and an uncased section in the area of the drainhole 32 has been provided by the drilling operation referred to previously. At this point the sensor is lowered into place by the wireline and seated in the perforated sub 14. The tubing string is then rotated into position shown whereby the end sub 18 is angled toward the opening of the horizontal drainhole.

Figure 4:
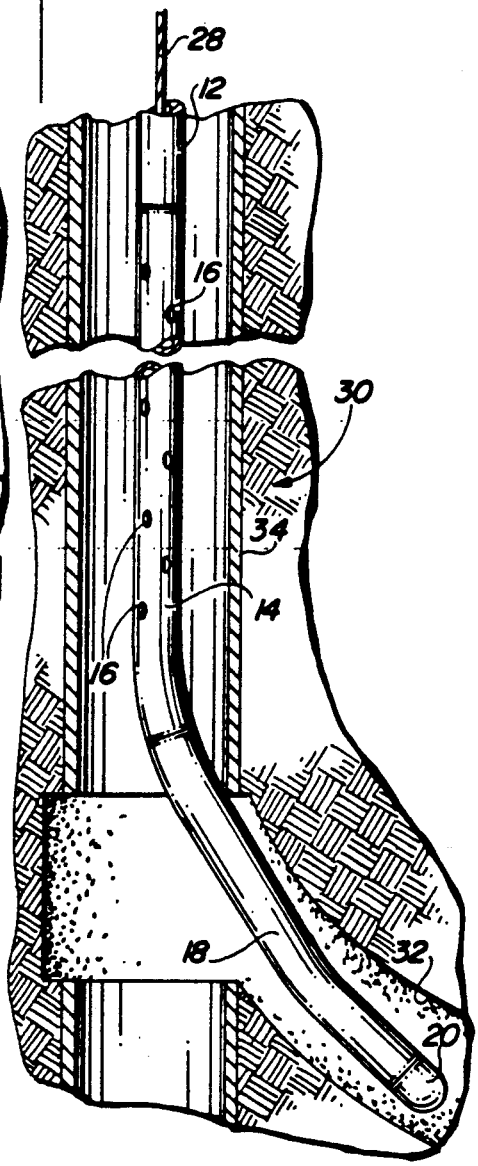
FIG. 4 is a view similar to that of FIG. 3, but showing the tubing string after is has traversed a portion of the horizontal drainhole.

Downward movement of the tubing string as it is worked into the drainhole causes the bullplug of the bent or angled end sub 18 to contact the lower portion of the wall of the horizontal drainhole 32 and to lead the tubing string into the drainhole. Continued movement of the tubing string causes the end sub to continue along the drainhole as shown in FIG. 4, with the bullplug 20 sliding along the drainhole wall and preventing the sub from snagging in the wall. The angle of the sub 18 allows it to more readily and easily follow the arc of the short radius drainhole 32.

Figure 5:
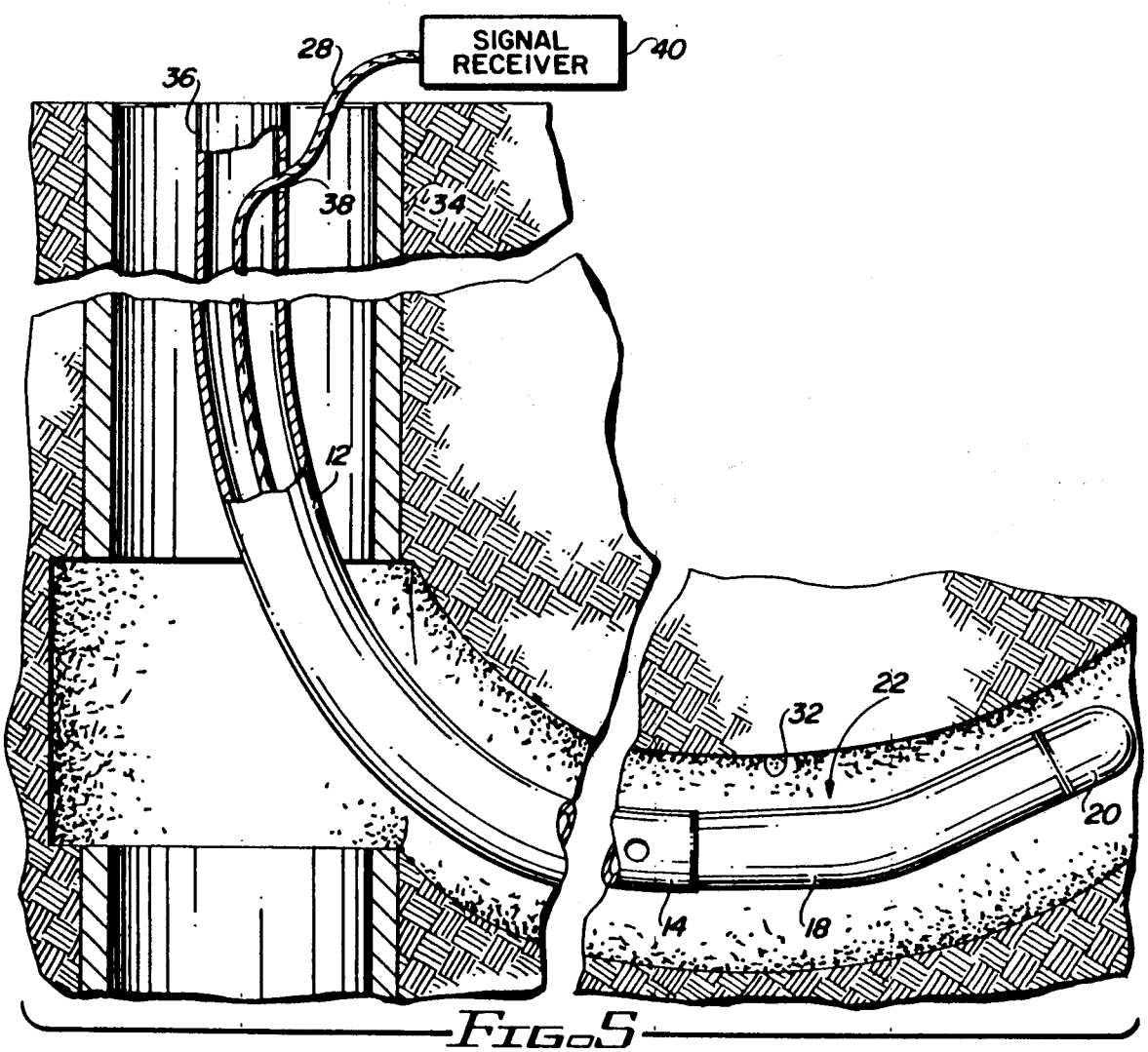
FIG. 5 is a view similar to that of FIG. 4, but on an enlarged scale, showing the tubing string in greater detail.

As shown in FIG. 5, which illustrates the tubing string after the end sub 18 has traversed a major portion of the length of the drainhole 32, the tubing string 12 has followed the subs 14 and 18 through the drainhole, curving in response to the curvature of the drainhole. The main body of the tubing string section 12 may conventionally be comprised of 30-foot lengths (about 9-meters) attached to each other by threaded connections. Since the tubing is quite narrow compared to its length, typically being 2 $\frac{3}{8}$ inches in diameter (approximately 6.0 centimeters), the portions of it which move through the drainhole are sufficiently flexible to assume the curvature of the drainhole. As shown at the top of FIG. 5, the upper portion of the tubing string comprises an exit sub 36 which contains an opening 38 through which the wireline 28 extends. This allows signals from the sensor to be received at the surface by a suitable receiver, shown schematically at 40, and subsequently processed.

The sub 14 containing the sensor support seat has been shown as containing perforations 16 through which the sensor may be exposed to the pressures and temperatures encountered in the drainhole. Although this is the most convenient form for openings in the sub 14 to take, allowing perforations to be drilled out in a conventional solid wall sub, it is not essential that the openings be formed in this manner. Any type or arrangement of openings which permit exposure of the sensor to the environment of the drainhole and which do not weaken the sub to the point where it cannot withstand the stresses encountered in its travel through the drainhole may be employed.

The end sub 18 has been described as bein bent to permit its downstream end to enter the horizontal drainhole and to follow the arc of the drainhole as the tubing string is worked down from the surface. Because the angles of the drainholes which may be encountered will vary, as well as their radius, the angle formed by the downstream end of the sub with its upstream end may also vary. For example, in one case the conditions of the drainhole were such that a 9° bend in the end sub provided the necessary change in direction needed to cause the sub to enter the drainhole and follow the drainhole along its sharply curved path. Obviously, other angles would be preferred if different drainhole conditions were encountered. Further, the invention should not be limited to the use of a sharp bend in the end portion of the tubing string. If it is found that a more gradual bend, more in the nature of a curve or an arc, will provide the desired function, such a design may be employed.

As stated above, the main body of the tubing string may be made up of standard lengths of tubing. While there is no set length for the end sub or the perforated sub it has been found that the sub will generally be relatively short, since its function is merely to provide the necessary angled arrangement for the end portion of the tubing string to enter and traverse the drainhole. The perforated sub will be as long as necessary to accommodate the sensor and provide adequate communication with the drainhole in order to adequately expose the sensor to the environment of the drainhole. As an example, in practice is has been found that an end sub 4 feet in length (about 1.2 meters) and a perforated sub 8 feet in length (about 4.2 meters) performed satisfactorily in combination with a sensor which measured 4 feed in length.

It will now be appreciated that the present invention provides a simple but effective method and means for introducing a sensor into a short radius horizontal drainhole and traversing the sensor throughout the length of the drainhole. The components required are readily available and are inexpensive to obtain and modify.

It will be understood that changes to the method and apparatus of the invention which do not affect the overall basic function and concept thereof may be made without departing from the spirit and scope of the invention, as defined in the appended claims.

What is claimed is:

1. Apparatus for use in logging a short radius horizontal drainhole, comprising:

a tubing string having a lower portion;

the lower portion of the tubing string including sensor support means therein;

the lower portion of the tubing string containing openings communicating with the interior thereof in the vicinity of the sensor support means to thereby expose the interior to the pressure and temperature conditions of the horizontal drainhole; and the lower portion of the tubing string including an end portion extending transversely of the tubing string.

2. The apparatus of claim 1, wherein the end portion of the tubing string comprises an end tubing sub, the end tubing sub including an upstream portion substantially aligned with the tubing string and a downstream portion forming an angle with the upstream portion.

3. The apparatus of claim 2, wherein the end tubing sub includes a bullplug at the downstream end thereof.

4. The apparatus of claim 2, wherein the portion of the tubing string containing openings comprises a perforated tubing sub attached to the upstream end of the end tubing sub.

5. The apparatus of claim 1, including pressure and temperature sensing means mounted on the sensor support means of the lower portion of the tubing string, and a wireline connected to the sensing means and extending through the tubing string.

6. In a method for logging a short radius horizontal drainhole intersecting a generally vertical borehole, the steps comprising:

providing a tubing string having a lower portion containing openings communicating with the interior thereof;

the lower portion of the tubing string including sensor means therein, the sensor means being located so as to be exposed the the exterior of the lower portion of the tubing string through the openings therein;

providing the lower portion of the tubing string with an end portion extending transversely of the tubing string;

substantially aligning said transversely extending end portion with the horizontal drainhole at the intersection between the horizontal drainhole and the generally vertical borehole; and moving the tubing string to cause the transversely extending end portion to enter the horizontal drainhole and guide the tubing string into the horizontal drainhole.

7. The method of claim 6, including the step of sending signals from the sensor means to the surface through a wireline extending from the sensor means through the tubing string.

8. The method of claim 6, wherein the end portion of the tubing string comprises an end tubing sub, the end tubing sub including an upstream portion substantially aligned with the tubing string and a downstream portion forming an angle with the upstream portion.

9. The method of claim 8, wherein the portion of the tubing string containing openings comprises a perforated tubing sub attached to the upstream end of the end tubing sub.

* * * * *